United States Patent [19]

Nakamura et al.

[11] Patent Number: 4,988,266

[45] Date of Patent: Jan. 29, 1991

[54] GAS TURBINE AND SHROUD FOR GAS TURBINE

[75] Inventors: Shigeyoshi Nakamura, Katsuta; Yutaka Fukui; Tetsuo Kashimura, both of Hitachi, all of Japan

[73] Assignee: Hitachi, Ltd., Tokyo, Japan

[21] Appl. No.: 321,880

[22] Filed: Mar. 10, 1989

[30] Foreign Application Priority Data

Mar. 14, 1988 [JP] Japan ..... 63-58326

[51] Int. Cl.[5] ..... F01D 5/20; F01D 9/00

[52] U.S. Cl. ..... 415/173.1; 415/173.6; 415/200; 416/241 R

[58] Field of Search ..... 415/173.1, 173.2, 173.3, 415/173.4, 173.5, 173.6, 915, 200, 216.1; 416/241 R, 241 B; 29/156.8 B; 420/109

[56] References Cited

U.S. PATENT DOCUMENTS

| | | | |
|---|---|---|---|
| 3,598,167 | 8/1971 | Snyderman | 164/517 X |
| 3,908,733 | 9/1975 | Brazer et al. | 164/122.1 X |
| 4,850,187 | 7/1989 | Siga et al. | 60/39.37 X |

*Primary Examiner*—Edward K. Look
*Assistant Examiner*—Hoang Nguyen
*Attorney, Agent, or Firm*—Antonelli, Terry, Stout & Kraus

[57] ABSTRACT

A gas turbine includes a turbine stubshaft, a plurality of turbine disks coupled to the shaft by turbine stacking bolts with spacers interposed therebetween, turbing moving blades planted in each of the disks, a shroud provided with a sliding surface in a spaced-apart relation to the tips of the moving blades, a distant piece connected to the disks by the bolts, a plurality of compressor disks coupled to the distant piece by compressor stacking bolts, compressor blades planted in each of the compressor disks, and a compressor stubshaft formed integrally with the compressor disk located at the first stage. At least a sliding portion of the shroud is made of a heat-resistant cast alloy having in turn a chilled layer and columnar grains in a direction oriented from the sliding surface thereof toward the interior thereof. A method of producing a segment-shaped shroud for a gas turbine by casting, comprises the steps of preparing a mold having a coated layer formed on at least a surface thereof which is to be in contact with a casting, the coated layer containing refractory aggregate powder at a main constituent, and refractory agent powder for accelerating generation of crystal nuclei, pouring the molten alloy into the mold, and forced-cooling the outer surface of the mold.

18 Claims, 8 Drawing Sheets

(A1) X1

(A4) X1

(A1) (GS 2.0) X400

(A4)(GS 4.5) X400

GAS TURBINE AND SHROUD FOR GAS TURBINE

BACKGROUND OF THE INVENTION

1. FIELD OF THE INVENTION

The present invention relates to an improved gas turbine and a shroud for such a gas turbine, and more particularly, to a shroud for a gas turbine which shroud is made of a heat-resistant iron-base alloy in which grains are refined so as to improve ductility and thermal fatigue resistance, to a gas turbine using the shroud and to a method of producing the shroud.

2. DESCRIPTION OF THE RELATED ART

A shroud for a gas turbine is of a segment-shaped type in which the individual segments are mechanically coupled to each other. Generally, the segments are made of a heat-resistant iron-base alloy and are produced by precision casting. The members of the shroud are subjected during the operation of the turbine to rapid heating and cooling which are repeated as the gas turbine is started and stopped. The thermal stress thus occurring causes the surfaces of the shroud segments which are exposed to a combustion gas to be cracked. U.S. Pat. No. 4,615,658 discloses a shroud made of SUS 310 steel or an improved alloy containing a particular component. However, neither description nor suggestion regarding the macrostructure and grain size of the material for the shroud is given in this publication.

As stated above, the shroud for the gas turbine is produced by precision casting. However, in the prior art the grain size of the casting was large with the result that cracks occurred by the repetition of heating and cooling, that is, there had been such a problem that a shroud is poor in thermal fatigue resistance.

SUMMARY OF THE INVENTION

An object of the present invention is to provide a gas turbine comprising a turbine stubshaft, a plurality of turbine disks coupled to said shaft by turbine stacking bolts with spacers interposed therebetween, moving turbine blades planted in each of said disks, a shroud having a sliding surface in a spaced-apart relation to the tips of said moving blades, a distant piece connected to said disks by said bolts, a plurality of compressor disks coupled to said distant piece by compressor stacking bolts, compressor blades planted in each of the compressor disks, and a compressor stubshaft formed integrally with first stage of the compressor disks, at least the turbine disks being made of martensite steel having a wholly annealed martensite structure and having a creep rupture strength of not less than 50 kgf/mm$^2$ under the conditions of 450° C. and $10^5$ hours and a V-notch Charpy impact strength of not less than of 5 kgf-m/cm$^2$ after having been held at 500° C. for $10^3$ hours, the moving blades located at the downstream of combustion gas being made longer in length, the shroud being made of a heat-resistant cast alloy having at least columnar grains directed inward from the sliding surface thereof.

Further, the turbine stacking bolts, the distant piece, the turbine spacers, at least the compressor disks located from the final stage to the central stage, and at least one of the compressor stacking bolts may be formed of a martensitic steel.

In the present invention, the martensitic steel that forms the turbine disks consists of 0.05 to 0.2 wt % C, not more than 0.5% Si, not more than 1.5% Mn (preferably not more than 0.6% Mn), 8 to 13% Cr, 1.5 to 3% Mo, not more than 3% Ni, 0.05 to 0.3% V, 0.02 to 0.2% in total at least one element selected from the group consisting of Nb and Ta, 0.02 to 0.1% N, and the balance Fe and incidental impurities, preferably the Mn/Ni ratio being not more than 0.11. More preferably, the martensitic steel has a wholly annealed martensitic structure, and consisting of 0.07 to 0.15% C, 0.01 to 0.1% Si, 0.1 to 0.4% Mn, 11 to 12.5% Cr, 2.2 to 3.0% Ni, 1.8 to 2.5% Mo, 0.04 to 0.08% in total at least one element selected from the group consisting of Nb and Ta, 0.15 to 0.25% V, 0.04 to 0.08% N, and the balance Fe and incidental impurities, the Mn/Ni ratio being 0.04 to 0.10.

Further, the martensitic steel according to the present invention may contain at least one additional element selected from the group consisting of not more than 1% W, not more than 0.5% Co, not more than 0.5% Cu, not more than 0.01% B, not more than 0.5% Ti, not more than 0.3% Al, not more than 0.1% Zr, not more than 0.1% Hf, not more than 0.01% Ca, not more than 0.01% Mg, not more than 0.01% Y, and not more than 0.1% rare earth elements.

The above-described martensitic steel is suitably used to form a turbine disk required to be very strong and ductile at a temperature near 500° C.

In the present invention, it is preferable for the turbine shaft is formed of a material consisting by weight of 0.2 to 0.4% C, 0.5 to 1.5% Mn, 0.1 to 0.5% Si, 0.5 to 1.5% Cr, not more than 0.5% Ni, 1.0 to 2.0% Mo, 0.1 to 0.3% V, and the balance Fe and incidental impurities.

Preferably, each of the stacking bolts, the turbine distant piece, the compressor stacking bolts and the turbine spacers are made of a material consisting by weight of 0.05 to 0.2% C, not more than 0.5% Si, not more than 1% Mn, 8 to 13% Cr, 1.5 to 3.0% Mo, not more than 3% Ni, 0.05 to 0.3% V, 0.02 to 0.2% Nb, 0.02 to 0.1% N, and the balance Fe and incidental impurities.

Preferably, the compressor blades are made of a martensitic steel consisting by weight of 0.05 to 0.2% of C, not more than 0.5% Si, not more than 1% Mn, 10 to 13% Cr, and the balance Fe and incidental impurities.

Preferably, the compressor disks disposed between the first stage and the central stage are made of a material consisting by weight of 0.15 to 0.30% C, not more than 0.5% Si, not more than 0.6% Mn, 1 to 2% Cr, 2.0 to 4.0% Ni, 0.5 to 1.0% Mo, 0.05 to 0.2% V, and the balance Fe and incidental impurities, while said compressor disks disposed on the downstream side from said central stage with the exception of at least a compressor disk of the final stage are made of a material consisting by weight of 0.2 to 0.4% C, 0.1 to 0.5% Si, 0.5 to 1.5% Mn, 0.5 to 1.5% Cr, not more than 0.5% Ni, 1.0 to 2.0% Mo, and 0.1 to 0.3% V, and the balance Fe and incidental impurities.

It is preferable for the compressor stub shaft to be made of a material consisting by weight of 0.15 to 0.3% C, not more than 0.6% Mn, not more than 0.5% Si, 2.0 to 4.0% Ni, 1 to 2% Cr, 0.5 to 1% Mo, and 0.05 to 0.2% V, and the balance Fe and incidental impurities.

The present invention provides a segment-shaped shroud provided with a sliding surface in a spaced-apart relation to the tips of turbine blades rotated by high-temperature gas, at least a sliding portion of said shroud, the sliding surface of which portion is in sliding relation to said blade, being made of a heat-resistant cast alloy having in turn a chilled layer and columnar grains in a direction oriented from the sliding surface toward an inner part of the shroud.

The heat-resistant cast alloy according to the present invention has a basic composition consisting by weight of 0.1 to 0.5% C, not more than 2% Si, not more than 2% Mn, 20 to 35% Cr, 18 to 40% Ni, and the balance Fe and incidental impurities or another composition consisting by weight of, in addition to said basic composition, at least one special element selected from the group consisting of not more than 0.5% Ti, not more than 0.5% Nb, not more than 0.5% rate earth elements, not more than 0.5% Y, not more than 0.5% Ca, not more than 0.5% Mg, and not more than 0.5% Al, or still another composition consisting by weight of, in addition to said basic composition or said another composition with said special element, at least one element selected from the group consisting of not more than 20% Co, not more than 10% Mo and not more than 10% W. In particular, it is preferable for the heat-resistant cast alloy of this invention to have both the basic composition and eutectic carbide containing Nb and Ti. Each of these components will be described below in detail.

C: C plays a very important role in improving thermal fatigue resistance and high-temperature strength. In order to prevent reduction in the strength, restrict precipitation of the o phase and prevent continuous precipitation of film-shaped carbide in grain boundary, the content of C is not less than 0.1%. Further, the content of C is not more than 0.5% , because high content of C increases the amount of brittle eutectic carbide and secondary carbide in the grain boundary with the result that there occurs reduction in the thermal fatigue resistance. It is most preferable for C to be in a range of 0.25% to 0.5% .

Cr: not more than 20% Cr is effective in restricting grain boundary corrosion of the shroud material caused by high-temperature corrosion. Further, the content of Cr is not more than 35% in order to prevent excess precipitation of carbide from occurring during the use at high temperature and to prevent embrittlement from occurring by the precipitation of the $\sigma$ phase. It is most preferable for Cr to be in a range of 25% to 30%.

Ni: Ni makes the matrix austenitic, improves the high-temperature strength, stabilize the structure and prevent the precipitation of the $\sigma$ phase. In order to achieve these objects, the content of Ni is not less than 20%. Further, a high content of Ni is preferable to obtain high-temperature corrosion resistance. However, high content of Ni increases the amount of eutectic carbide, which causes reduction in thermal fatigue resistance. The content of Ni is therefore preferably between 20% and 40%, and more preferably, between 25% and 35%.

Ti, Nb, Zr: If any one of these elements is added, it forms ZrC, TiC or NbC. If these elements are added in any combination, they form MC type carbide such as (Ti, Nb, Zr) C. Although precipitation hardening brought about by these elements are not large in view of their small contents, they adequately restrict both the precipitation and growth of the secondary Cr carbide to thereby restrict a reduction in the high-temperature strength over a long period of time. Further, it is also effective in restricting the continuous precipitation of the Cr carbide in the grain boundary. The content of any of these elements is not less than 0.1%. However, if the content is high, the MC carbide increases and the secondary Cr carbide thereby decreases. In order to prevent a reduction in the high-temperature strength, the content of any of these elements is not more than 0.5% . It is most preferable for the M/C (M representing the sum of metal elements that form the MC carbide) in terms of atomic ratio to be between 0.2 and 0.3. Preferably, the contents of Ti, Ni and Zr are in ranges of 0.1 to 0.5% , 0.1 to 0.3% and 0.1 to 0.3%, respectively.

Ca, Mg, Al, Y, rare earth elements: These elements are contained in order to make the functions of Ti, Nb and Zr effective. A high content of these elements causes casting cracks. The amount in total of these elements to be added is preferably in a range of 0.1 to 1%, and more preferably 0.1 to 0.5% . The content in total of these elements is in a range of 0.005 to 0.5% .

W, Mo: W and Mo are added to strengthen a base material by solid-solution hardening. The larger the amount, the more the high-temperature strength is improved. However, if the total amount of W and Mo is too large, the amount of eutectic carbide increases, and the thermal fatigue resistance thereby reduces. From this viewpoint, the total content of these elements is not more than 10%.

Co: Co is added to strengthen a base material by solid-solution hardening. The content of Co is between 5% and 20%, because Co more than 20% is less effective to increase the solid-solution hardening.

Si and Mn: These elements are effective deoxidizers. It is preferable for each of these elements to be in a range of 2% or less.

The shroud for the gas turbine according to the present invention is made of a heat-resistant cast alloy having excellent strength and ductility which enables the sliding surface of the shroud to withstand a use of 30 thousands hours. The heat-resistant cast alloy has a tensile strength of not less than 40 kgf/mm$^2$ and an elongation of not less than 5% at a room temperature, and a tensile strength of not less than 20 kgf/mm$^2$ and an elongation of not less than 5% at 760° C., and a creep rupture time of not less than 10 hours under a conditions of 871° C. and 5.5 kgf/mm$^2$.

The portion of the shroud for the gas turbine according to the present invention which portion faces the first stage of the moving turbine blades is made of Ni-base cast alloy having an austenitic structure and consisting of 0.05 to 0.2% C, not more than 2% Si, not more than 2% Mn, 17 to 27% Cr, not more than 5% Co, 5 to 15% Mo, 10 to 30% Fe, not more than 5% W, not more than 0.02% B, and the balance of Ni and incidental impurities. Other portion of the shroud which faces the remaining stages of the turbine blades is made of Fe-base cast alloy consisting by weight of 0.3 to 0.6% C, not more than 2% Si, not more than 2% Mn, 20 to 27% Cr, 20 to 30% Ni, 0.1 to 0.5% Nb, 0.1 to 0.5% Ti and the balance of Fe and incidental impurities, at least a sliding portion of the shroud, which portion is in sliding relation to the moving turbine blade, being provided with columnar grain growing from the sliding face toward the interior of the shroud.

The method of producing the shroud used for the gas turbine by casting, which shroud is provided in a spaced-apart relation to the tips of turbine blades rotated by high-temperature gas and which shroud is made of a heat-resistant cast alloy, comprising the steps of:

preparing a mold having a coated layer formed on at least a surface thereof which is in contact with a casting, the coated layer containing refractory aggregate powder as a main constituent, and refractory agent powder for accelerating generation of crystal nuclei;

pouring the molten alloy into the mold; and forced-cooling an outer surface of the mood.

At least the surface of the mold employed in the method of the present invention which surface is contact with a casting is coated with a mold material which contains a main constituent of zirconium oxide powder as aggregate and at least one component of not more than 10% as a refractory agent for accelerating the generation of crystal nuclei which at least one component is selected from the group consisting of cobalt aluminate powder, cobalt oxide powder, tricobalt tetroxide powder, and cobalt titanate powder. Zirconium oxide powder which is contained as aggregate has preferably a grain size of 1 to 10 μm. The refractory agent such as cobalt aluminate powder, which is added to accelerate generation of crystal nuclei, preferably has a grain size of 0.1 to 1 μm. This mold material may also contain several % of an inorganic binder such as colloidal silica and an extending agent such as silicon dioxide powder and etc. which acts as an aggregate.

Further, the shroud for the gas turbine according to the present invention is produced by the process comprising the steps of: preparing a mold having a coated layer formed on at least the surface thereof which is to be in contact with a casting which coated layer contains refractory aggregate powder as a main constituent and a refractory agent powder for generating crystal nuclei; pouring molten metal of the above-described heat-resistant alloy into the thus-prepared mold and solidifying the molten alloy; and forming the sliding surface of said shroud by using a portion of the casting which portion is in contact with the bottom of the mold.

To prepare the mold employed in the method according to the present invention, a lost wax mold, which serves as a pattern, is immersed in a slurry containing the above-described inorganic binder, aggregate and refractory agent so as to form a coated layer of a predetermined thickness. It is sufficient for this layer to be one layer, which layer is in a range between 0.5 mm and 1 mm. On this coated layer are formed other coated layers having desired thicknesses by repeating both the immersing of the lost wax mold into another slurry containing only an aggregate without refractory agent and the drying of the coated layer, so that the resulting mold has a sufficient thickness to hold cast molten metal. Each of the layers formed by using slurry containing only aggregate has a thickness ranging from 0.5 mm to 1 mm. The total thickness of the layers is set at about 1 cm.

Generally, water is used to prepare the slurry. After a desired mold containing wax has been formed, the mold is heated for drying and dewaxing. Further, the mold is preheated at a temperature near 600° to 700° C. when molten alloy is poured into it. In the case of the above-described iron-based heat-resistant cast alloy, the casting is performed at a temperature ranging between 1500° and 1550° C. The molten alloy poured into the mold is forced-cooled and solidified by an air blast.

In the present invention, after the casting, it is preferable for the shroud to be subjected to solution-heat treatment so as to make the composition uniform. In this solution-heat treatment, the shroud is forced-cooled by an air blast in order to prevent precipitation from occurring. After the solution-heat treatment, the shroud may be subjected to an aging treatment. The aging treatment is performed at a temperature higher than a temperature at which the shroud is used in a steady state. It is preferable for the aging to be performed at a temperature ranging between 800° and 900° C.

As stated above, the shroud for the gas turbine is exposed to high-temperature gas and is subjected to rapid heating and rapid cooling during operation. This is particularly true with respect to the sliding surface of the shroud which slides against the moving turbine blades. The conventional shroud which is used in these situations, however, exhibits strength, ductility, and thermal fatigue resistance all of which are insufficient. On the other hand, in the shroud for the gas turbine according to the present invention, at least the sliding surface of the shroud which slides against the moving turbine blades is formed of a cast alloy in which a chilled layer and columnar grains are formed in turn in a direction oriented from the sliding surface to the interior of the shroud, that is, the chilled layer being located at the outermost portion of the surface, so that the grains can be refined in size and the thermal fatigue resistance can be improved greatly. The chilled layer is constituted by refined grains, and is indispensable to improve thermal fatigue resistance. Further, the columnar grain structure is capable of preventing cracks caused on the surface from being transmitted inwardly.

The material for the shroud according to the present invention exhibits excellent high-temperature strength and superior high-temperature ductility, and the material which forms the sliding surface thereof withstands the use thereof at a working temperature of 750° C. or above, and withstands preferably 800° C. or above.

In the gas turbine according to the present invention, since the turbine disks are made of a martensitic steel having the aforementioned composition, the temperature of the combustion gas in the gas turbine can be set at 1250° C. or above, or preferably, at 1300° C. or above, thereby improving the thermal efficiency of the gas turbine by 33% or above and ensuring a service life of about 30 thousands hours.

Thus, a shroud for a gas turbine according to the present invention has excellent thermal fatigue resistance, and a gas turbine according to the prevent invention can be operated at a higher gas temperature, and exhibits the above-described high thermal efficiency.

DESCRIPTION OF THE PREFERRED EMBODIMENTS

Embodiment 1

Patterns having a shape of samples having a thickness of 32 mm were made by the lost wax method. Coating was then provided on these lost wax patterns in the following manner so as to obtain molds.

Various water slurries to form the first layers to be coated on the surfaces of the lost wax patterns were prepared by first preparing mixtures each containing an aggregate as a main constituent and a binder and then by adding various amounts of grain-refining refractory agent into the mixtures while the mixtures were being stirred at a speed of about 600 rpm. In this embodiment, $ZrO_2$ powder having a grain size of 1 to 10 μm was used as the aggregate, and colloidal silica was used as the binder. Cobalt aluminate powder having a grain size of about 1 μm was added as the grain-refiring agent into the mixtures by 0% (A1), 2% (A2), 3% (A3), 5% (A4) and 7% (A5). The surfaces of the lost wax patterns were then coated respectively by using the thus-prepared slurries to form the first layers. Each of these layers had a thickness of about 0.5 mm. Subsequently, eight layers from the second layer to the ninth layer were formed on the first layer of each lost wax pattern by coating a water slurry on it, which slurry contained $ZrO_2$ powder which acted as the aggregate and colloidal silica which acted as the binder. The resultant molds had a thickness of about 7 mm. Each of the eight layers was 0.5 to 1 mm thick. Next, the molds were heated at 200° C. to dry the layers and to dewax them. After the dewaxing, molten iron-base alloy having a composition listed in Table 1, which was melted under atmospheric air, was poured into each of the thus-prepared molds. The molds were preheated at a temperature of 650° C., and the temperature of pouring was 1500° to 1520° C. Atmospheric melting and atmospheric pouring were adopted. Regarding the components, only Ti was added to the molten alloy immediately before casting. After the pouring of the molten metal, the molds were forced-cooled by air blast. Thereafter, the articles of cast alloy were subjected to a heat treatment of a type usually conducted on the iron-base alloy, that is, the casting were held at a temperature of 1150° C. for three hours, and then forced-cooled by air blast. This quenching prevented segregation of the components from occurring, makes a part of carbide form solid-solution, and allows fine carbide to be formed.

From the samples which were thus prepared by using the molds containing various amounts of refractory agent there were prepared specimens to be used for the measurements of the macrostructure and grain size, specimens having a diameter of 6 mm to be used for tensile test, and specimens having a diameter of 20 mm and a height of 20 mm to be used for thermal fatigue resistance test.

Figure 2A:
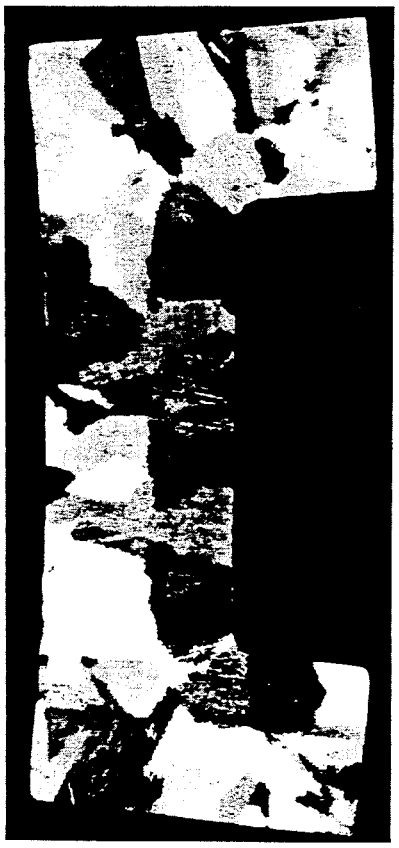
FIGS. 2(A), 2(B), 4(A) and 4(B) are microphotographs showing the metal structure of the section of the shroud.
Figure 2B:
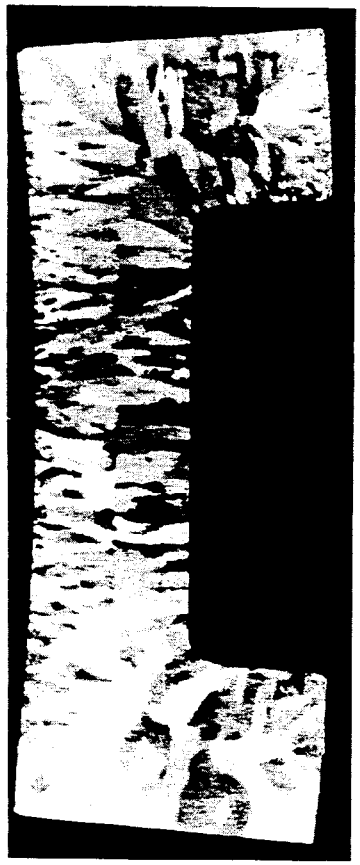

The specimens to be used for the measurement of the macrostructure were prepared by polishing the sections and then by immersing them into aqua regia to corrode them. The specimens to be used for the measurement of the grain size were prepared by the steps of polishing the specimens, subjecting them to a sensitizing treatment which comprises holding at 670° C. for 72 hours and air-cooling, and corroding them with aqua regia and glyceline. FIG. 2 shows the results of the macrostructure observations (about 1 in magnification). Al represents the macrostructure of a casting produced by the conventional method using a mold which does not contain refractory agent, and A4 represents the macrostructure of another casting obtained in accordance with the present invention by using a mold which contains 5% refractory agent. As can be seen in FIG. 2, no chilled layer was formed in A1, which shows a macro structure having large crystals. However, in A4, the chilled layer and the columnar grains were formed in turn in a direction oriented from the surface to the interior thereof, that is, the chilled layer was formed on the outermost surface of the surface. Further, the thickness of the chilled layer formed differs, depending on the content of the refractory agent. About 1.5 mm of chilled layer was formed when the content of the refractory agent was 1%. With 3% of refractory agent, the chilled layer had a thickness of about 5 mm. The thickness of the chilled layer formed increases as the content of the refractory agent increases. Substantially no chilled layer was formed in a casting obtained by using a mold containing no refractory agent, which casting is constituted by coarse grains.

TABLE 1

| C | Mn | P | S | Cr | Ni | Si | Nb | Ti | Fe |
|---|---|---|---|---|---|---|---|---|---|
| 0.39 | 0.89 | 0.004 | 0.002 | 23.0 | 24.7 | 0.76 | 0.27 | 0.30 | Balance |

Figure 3:
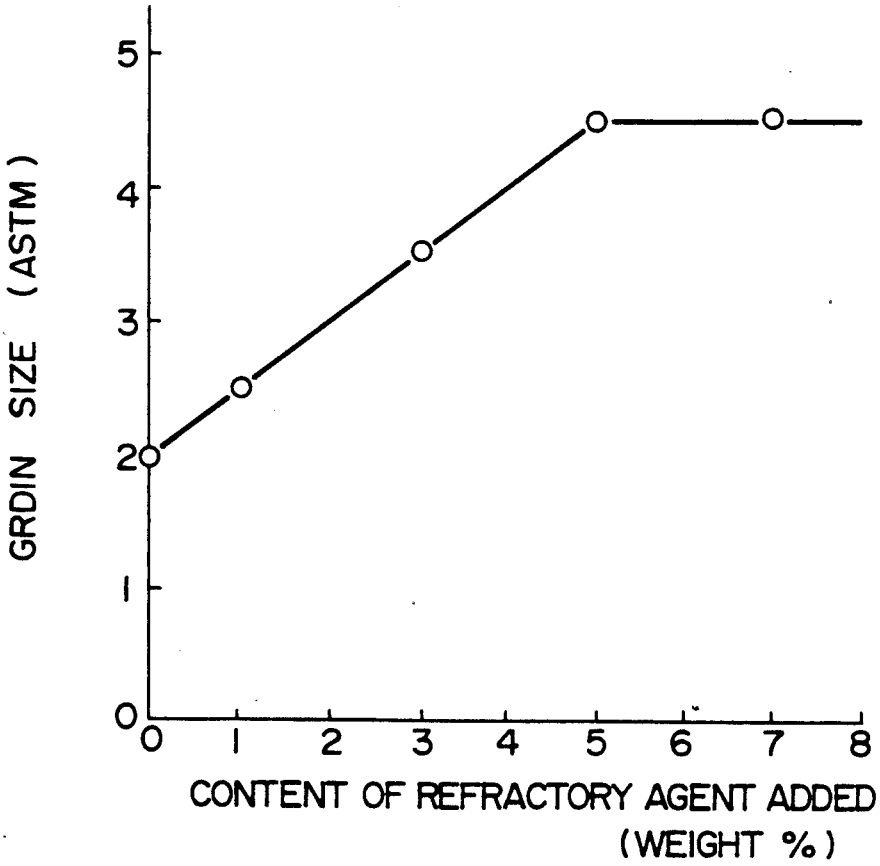
FIG. 3 is a graph showing the relationship between the content of the refractory agent added and the ASTM grain size.

FIG. 3 shows the relationship between the content of the refractory agent and the ASTM grain size of the columnar grains. In a case where the content of the refractory agent is 5% or below, the grain decreases in size (grain size number increases) as the content of the refractory agent increases. However, no reduction in size is observed when the content of the refractory agent is 5 wt % or above. Since it is preferable that a casting that forms the shroud of the gas turbine has a grain size of 3 or above, the content of the refractory agent is set at 2% or above.

Figure 4A:
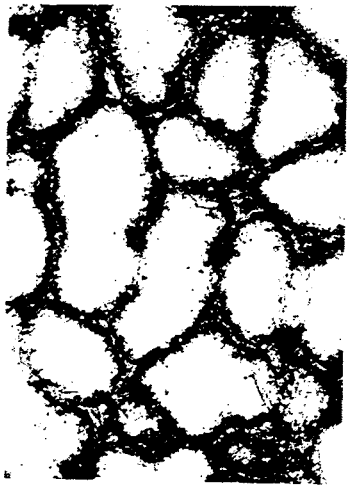
Figure 4B:
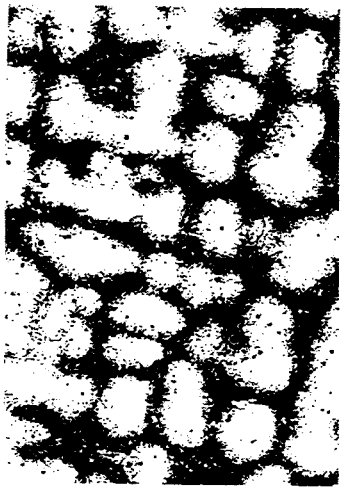

FIG. 4 shows the microphotographs (400 in magnification) of samples A1 and A4. A1 obtained without using refractory agent had a grain size number of 2.0, and A4 obtained by using a mold containing 5% of refractory agent had a grain size number of 4.5, which means that A4 had finer grains. Both of the structures showed a state in which secondary carbide was precipitated around the eutectic carbide.

Figure 5:
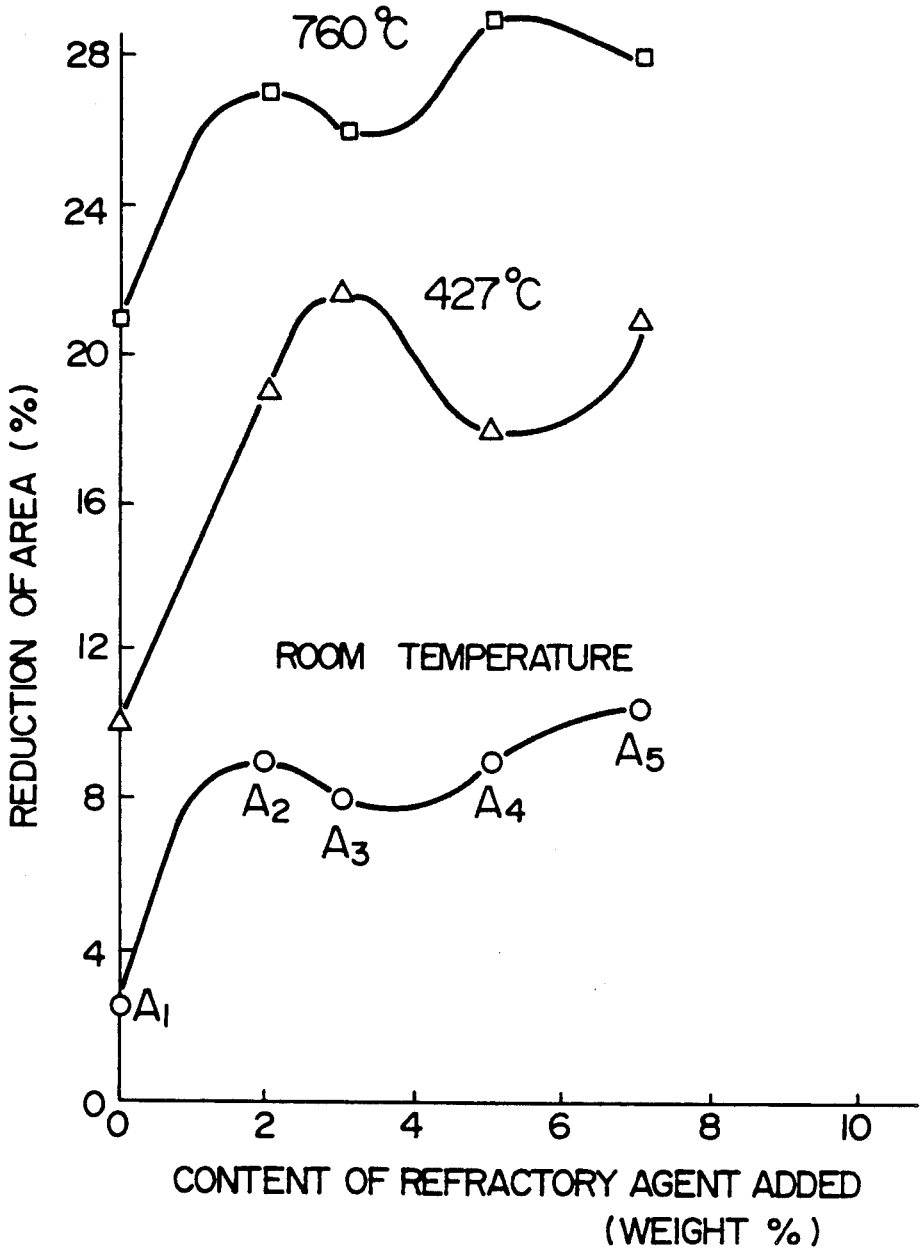
FIG. 5 is a graph showing the relationship between the content of the refractory agent added and the reduction of area obtained after the tensile test.

FIG. 5 is a graph showing the relationship between the reduction of area obtained in the samples subjected to tensile test and the content of the refractory agent. As is seen in the graph, the reduction of area of the sample obtained by using a mold containing refractory agent is about 3 times, about 2 times and about 1.3 times greater than that of the sample obtained by the conventional method without using refractory agent at a room temperature, at 427° C., and at 760° C., respectively, which means that the samples obtained according to the present invention exhibited greatly improved ductility at any of the above-shown temperatures. In particular, when the content of the refractory agent is 2%, the ductility was improved most greatly. The ductility can be improved when the content of the refractory agent is not less than 1%.

Figure 6A:
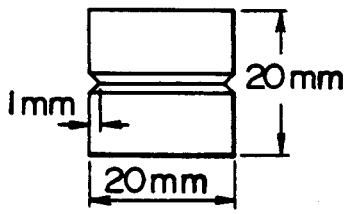
FIGS. 6A and 6B show the shape of a sample employed in a heat cycling test, and a heat cycle curve, respectively.
Figure 6B:
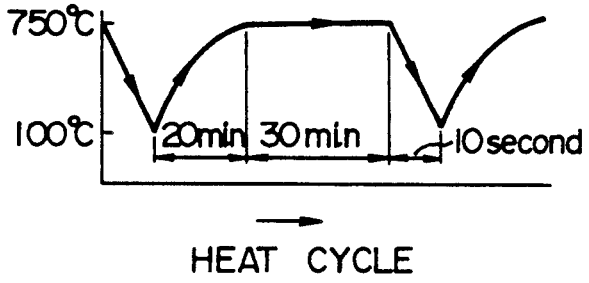
Figure 7:
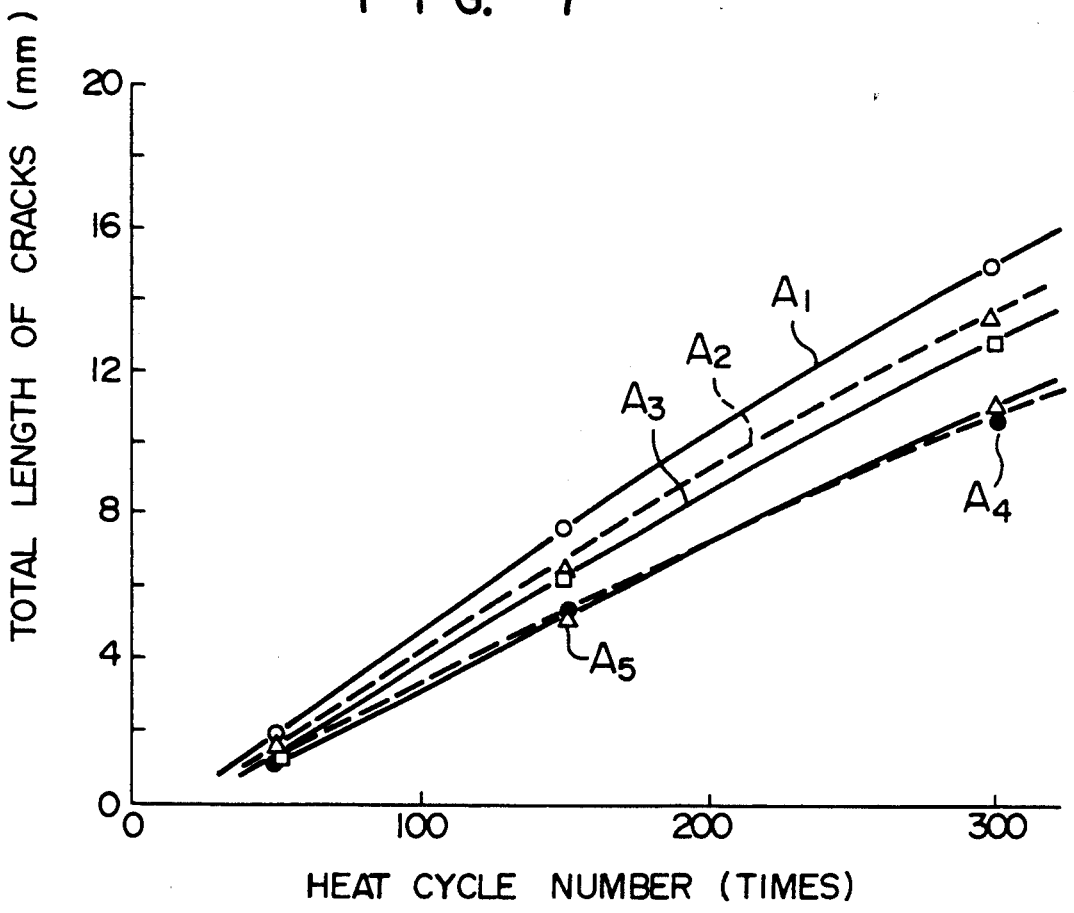
FIG. 7 is a graph showing the relationship between the number of heat cycle and the total length of cracks.

FIGS. 6 (*a*) and (*b*) show the shape of the samples employed in the thermal fatigue resistance test (with a notch formed at an angle of 45°) and the heating/cooling mode of the heat cycle test, respectively. FIG. 7 is a graph showing the relationship between the times of the heat cycles repeated and the total length of the cracks occurred. The samples had a V-shaped notch of 45 degrees having a depth of 1 mm at the central portion thereof. The samples were subjected to heat cycles of 50 times, 150 times and 300 times, respectively. These samples were then divided into two parts, and the total length of the cracks occurred on the section of each sample was measured. As can be seen in FIG. 7, as the number of times of the heat cycles repeated increases, the total length of the cracks increases substantially linearly.

As shown in FIG. 7, the lengths of the cracks occurred in the samples A2, A3, A4 and A5 obtained according to the present invention by using a mold containing refractory agent are shorter than that of the sample A1 obtained by the conventional method using a mold containing no refractory agent, which means that the samples A2, A3, A4 and A5 have excellent thermal fatigue resistance.

Figure 8:
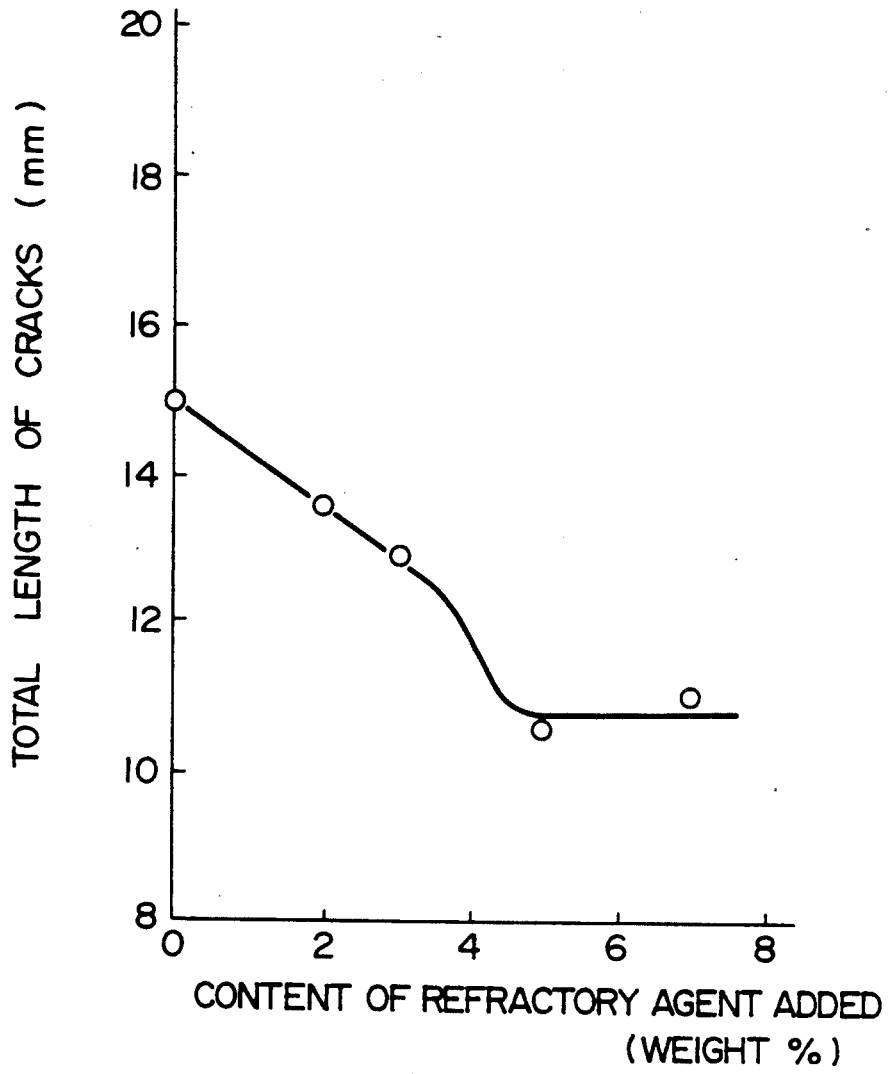
FIG. 8 is a graph showing the relationship between the content of the refractory agent added and the total length of cracks.

FIG. 8 is a graph showing the relationship between the content of the refractory agent and the total lengths of the cracks occurred in the samples which had been subjected to heat cycles of 300 times. As is clear from the graph, as the content of the refractory agent increases, the length of the cracks greatly reduces, which means that the thermal fatigue resistance has been improved. In particular, the length of the cracks becomes a minimum when the content of the refractory agent is about 4%, however, the length of the cracks does not become smaller even if the content is more than 4%.

The samples employed in the aforementioned characteristic tests were collected from the central portions of the articles of precision cast alloy, and therefore did not contain the chilled layer, because the chilled layer is formed on the surface of a casting. It is therefore apparent that the samples containing the chilled layer will exhibit the more excellent characteristics.

Table 2 shows the mechanical properties of the aforementioned A4. Table 3 shows the results of creep rupture test of A1 and A4 under conditions of 5.5 kgf/mm$^2$ and 871° C.

TABLE 2

| | Room temperature | 427° C. | 760° C. |
|---|---|---|---|
| Tensile strength (kgf/mm$^2$) | 48.7 | 44.3 | 25.0 |
| Yield strength (kgf/mm$^2$) | 25.9 | 19.7 | 13.0 |
| Elongation (%) | 8 | 14 | 29 |
| Reduction of area (%) | 8 | 19 | 35 |

TABLE 3

| | Rupture time (h) | Elongation (%) | Reduction of area (%) |
|---|---|---|---|
| A1 | 53 | 35 | 86 |
| A4 | 126 | 36 | 84 |

As is clear from the Tables 2 and 3, the samples obtained according to the present invention exhibit a tensile strength of not less than 40 kgf/mm$^2$ and an elongation of not less than 5% at a room temperature, a tensile strength of not less than 20 kgf/mm$^2$ and an elongation of not less than 5% at 760° C., and a creep rupture time of not less than 10 hours at 871° C. and 5.5 kgf/mm$^2$. These samples were obtained from the central portion of castings and therefore contained the columnar grains but did not contain the chilled layer. The portion of the sample which contains the chilled layer is expected to have more excellent characteristics.

Embodiment 2

Figure 1:
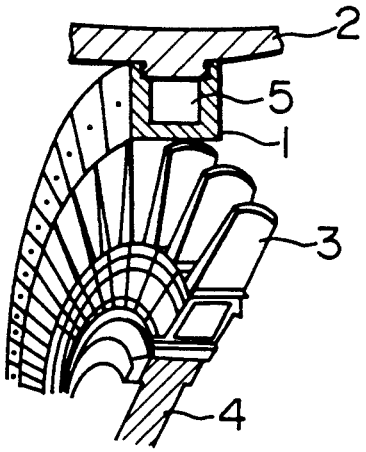
FIG. 1 is a perspective view of the rotary portion of a gas turbine having a shroud and turbine blades according to the present invention.
Figure 9:
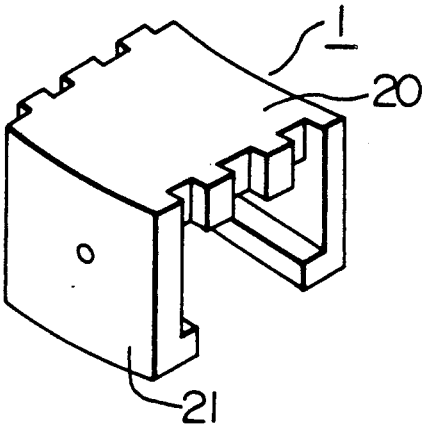
FIG. 9 is a perspective view of a shroud for a gas turbine.

FIG. 1 is a partially sectioned perspective view of the rotary portion of a gas turbine, showing another embodiment of the present invention. In this embodiment, each of the segments of a shroud 1 was incorporated over the whole periphery of a turbine casing 2 in a ring-shaped form. The shroud 2 of this embodiment was obtained in the same casting as that of Embodiment 1. The shroud 1 was constituted in such a manner that a gap defined between a sliding surface thereof and a gas turbine blade 3 was reduced as small as possible at the operating time of the gas turbine. Thus, the sliding surface 20 of the shroud has a curved structure as shown in FIG. 9. Since this sliding surface 20 is exposed to high-temperature combustion gas and is subjected to rapid heating and air-cooling when the gas turbine is started and stopped, cracks are apt to occur due to heat cycle fatigue. It is therefore required that the shroud is formed of a material having a high ductility at both low and high temperatures. The sliding surface 20 was produced by precision casting as stated above. However, since in general the surface of an as-cast state has irregularities, cutting of a predetermined thickness was effected to obtain the sliding surface 20 so that the resultant sliding-surface had an accurate dimension, and then the sliding surface was polished. As has been described above, a chilled layer must be formed on this sliding surface 20 and must have a predetermined thickness after the cutting has been conducted on the sliding surface. Preferably, the shroud is produced by the precision casting so as to have this curved form. In this way, the thickness of the chilled layer formed in a part of a casting which part forms the sliding surface can be made uniform and large over the entire sliding surface. This enables the service life of the shroud to be prolonged. In this embodiment, a hot top (, that is, a feeding heat) was provided on a side surface 21 at the time of effecting the pouring, the sliding surface 20 being made to be formed at the bottom portion of the mold, and casting means was adopted which ensures that the portion of the molten alloy that forms the sliding surface 20 was able to be rapidly cooled after it had been poured into the mold. This resulted in formation of the chilled layer having a desired thickness. The chilled layer was constituted by fine grains. The chilled layer also served to refine the columnar grains formed after the chilled layer had been formed. The thermal fatigue resistance can be improved by the fine grains of the chilled layer formed on the surface. In the above-described embodiment, the samples taken from the inner portions of the castings were used to estimate the characteristics thereof. Thus, more excellent characteristics will be obtained, if the samples are taken from the surfaces of the castings are used, because the grain size of the chilled layer is finer than that of the columnar grains by at least 2 in terms of GS number. By forming the sliding surface 20 in a casting portion opposing against the bottom portion of the mold, the metal structure of the sliding portion can be made uniform, which leads to prolongation of the service life.

The shroud 1 has an air-cooling hole 5 in it. Air passes through the hole 5 and cools the shroud 1 during the operation of a gas turbine.

Figure 10:
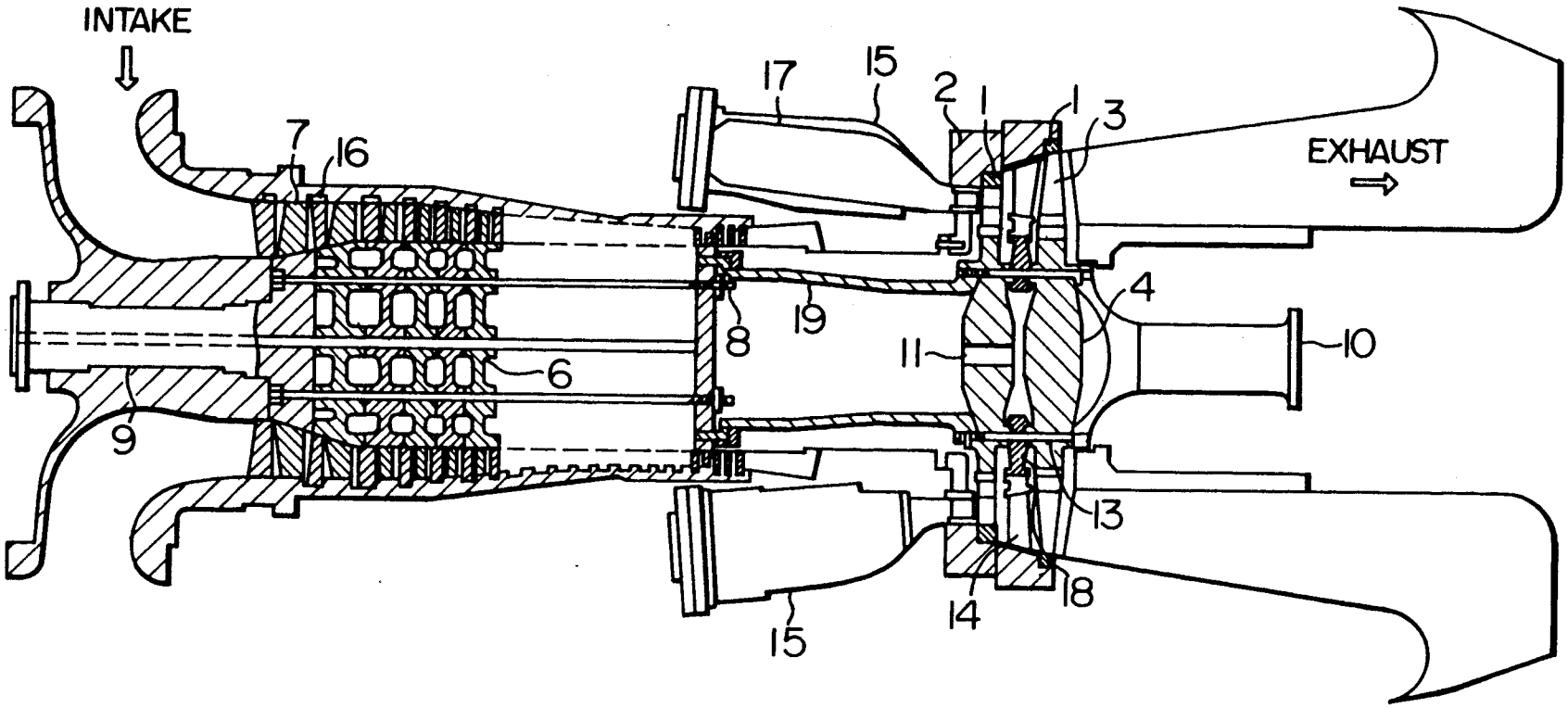
FIG. 10 is a sectional view showing a gas turbine according to the present invention.

FIG. 10 is a cross-sectional view of a gas turbine having a rotary portion that incorporates the shroud shown in FIG. 1. A gas turbine included a shroud 1, a turbine casing 2, a turbine stubshaft 10, turbine buckets 3, turbine disks 4, turbine stacking bolts 13, turbine spacers 18, a distance piece 19, compressor disks 6, compressor blades 7, compressor stacking bolts 8, a compressor stubshaft 9, a turbine disk 10, and a central hole 11. The gas turbine of this embodiment incorporated a 17-stage compressor 6, and a 2-stage turbine bucket 3. The turbine buckets may also have three stages.

Figure 11:
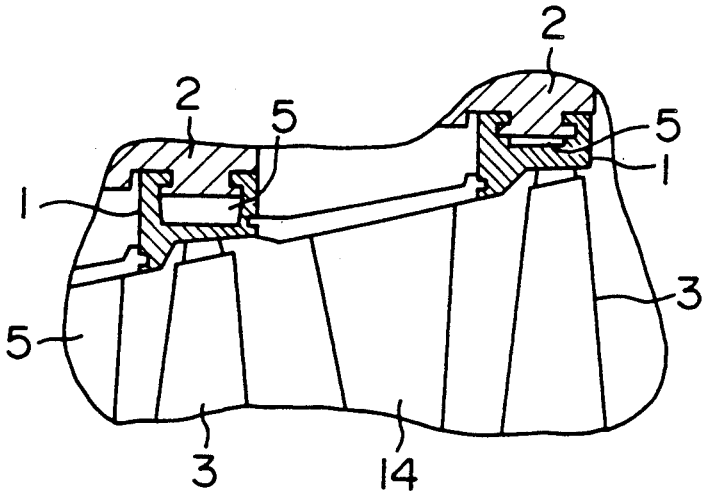
FIG. 11 is an enlarged view showing a relationship between shrouds and turbine blades with respect to another embodiment.

FIG. 11 is a cross-sectional view of the essential parts of the shroud 1 incorporated in the gas turbine shown in FIG. 10. The portion of the shroud of this embodiment which portion slides against the turbine buckets 3 had a complicating form, as compared with that of Embodiment 1. The buckets 3 located downstream of the exhaust gas (on the right side as viewed in FIG. 11) were made longer in length. The sliding surface portion of the shroud was inclined in conformity with the varying length of the buckets 3 and was made to have the same thickness. This enabled formation of the chilled layer by the precision casting, reduced the occurrence of non-uniform macrostructure (irregularities thereof), and thereby enabled the provision of a balanced shroud. The shroud of a structure shown in FIG. 11 also had segments arranged over the whole periphery of the casing 2, the sliding surface of which shroud was finished by cutting. The sliding surface of the shroud was curved in conformity with the rotating radius of the bucket 3, and had a chilled layer of a desired thickness (about 5 mm or above). These enabled the resultant gas turbine to be used for about 30 thousands hours without occurrence of substantial cracks on the sliding surface of the shroud which substantial occurrence makes it impossible to operate the gas turbine.

The compositions of the materials that form the major components of the gas turbine employed in this embodiment will be described below, as well as the characteristics of these materials.

Life-sized large shape steels were melted by an electroslag remelting method, and these steels were subjected to forging and heat-treatment to produce the materials listed in Table 4. The steel that forms the turbine disks was melted by the vacuum carbon deoxidation. The foregoing was conducted at a temperature ranging from 850° to 1150° C., and the heat treatment was conducted under the conditions shown in Table 4 to obtain samples. The table 4 shows the chemical compositions (in wt %) of the resultant samples. The microstructure of material Nos. 1 to 4 and No. 7 was a wholly annealed martensitic structure, and the microstructure of material Nos. 5 and 6 was a wholly annealed bainate structure. The material No. 1 was used to form both the distant piece and the compressor disk disposed at the final stage. The material No. 5 was used to form the compressor disks 6 located from the 13th stage to the 16th stage. The material No. 6 was used to form the compressor disks 6 located from the first stage to the 12 stage. These samples were produced to have the same size as that of the turbine disks. After the heat treatment, specimens were taken from the central portions of the samples in the direction vertical with respect to the axial direction (the longitudinal direction) except for the sample No. 4. Regarding the sample No. 4, a specimen was taken in the longitudinal direction.

Table 5 shows the tensile strength at a room temperature, the V-shaped notch Charpy impact strength at 20° C., and the creep rupture strength at 450° C. for $10^5$ hours obtained by Rarson Miller method usually used.

TABLE 4

| Examples, Kind of Steel | | Chemical Composition (wt %) C | Si | Mn | Cr | Ni | Mo | V | Nb | N | Fe | Heat Treatment |
|---|---|---|---|---|---|---|---|---|---|---|---|---|
| (Distant Piece) | 1 | 0.10 | 0.04 | 0.70 | 11.56 | 1.98 | 1.98 | 0.20 | 0.08 | 0.06 | Balance | 1050° C. × 5 hOQ<br>550° C. × 15 hAC<br>600° C. × 15 hAC |
| (Turbine Disk) | 2 | 0.10 | 0.05 | 0.65 | 11.49 | 1.70 | 2.04 | 0.19 | 0.08 | 0.06 | Balance | 1050° C. × 8 hOQ<br>600° C. × 20 hAC<br>600° C. × 20 hAC |
| (Spacer) | 3 | 0.09 | 0.07 | 0.59 | 11.57 | 2.31 | 2.22 | 0.18 | 0.09 | 0.06 | Balance | 1050° C. × 3 hOQ<br>550° C. × 10 hAC<br>600° C. × 10 hAC |
| (Stacking Bolt) | 4 | 0.10 | 0.03 | 0.69 | 11.94 | 1.86 | 2.25 | 0.21 | 0.15 | 0.05 | Balance | 1050° C. × 1 hOQ<br>550° C. × 2 hAC<br>600° C. × 2 hAC |
| Cr Mo V Steel | 5 | 0.26 | 0.25 | 0.79 | 1.09 | 0.41 | 1.25 | 0.23 | — | — | Balance | 975° C. × 8 hWQ<br>665° C. × 25 hAC<br>665° C. × 25 hAC |
| Ni Cr Mo V Steel | 6 | 0.20 | 0.21 | 0.36 | 1.51 | 2.78 | 0.62 | 0.10 | — | — | Balance | 840° C. × 8 hWQ<br>635° C. × 25 hAC<br>635° C. × 25 hAC |
| (Turbine Disk) | 7 | 0.12 | 0.04 | 0.21 | 11.21 | 2.68 | 2.04 | 0.21 | 0.07 | 0.06 | Balance | 1050° C. × 2 hOQ<br>520° C. × 5 hAC<br>590° C. × 5 hAC |

TABLE 5

| Example kind of steel | Tensile strength ($kgf/mm^2$) | 0.2% Yield strength ($kgf/mm^2$) | Elongation (%) | Reduction of area (%) | Impact strength $vE_{20}$ ($kgf\text{-}m/cm^2$) | $10^5$ h Creep rupture strength ($kgf/mm^2$) 450° C. |
|---|---|---|---|---|---|---|
| 1 | 112.0 | 79.3 | 19.8 | 60.1 | 8.7 | 51.1 |
| 2 | 111.7 | 79.5 | 20.1 | 59.3 | 8.3 | 52.3 |
| 3 | 114.3 | 81.2 | 19.5 | 62.5 | 7.2 | 51.3 |

TABLE 5-continued

| Example kind of steel | Tensile strength (kgf/mm²) | 0.2% Yield strength (kgf/mm²) | Elongation (%) | Reduction of area (%) | Impact strength $vE_{20}$ (kgf-m/cm²) | $10^5$ h Creep rupture strength (kgf/mm²) 450° C. |
|---|---|---|---|---|---|---|
| 4 | 115.7 | 82.6 | 22.3 | 63.4 | 8.7 | 52.7 |
| 5 | 86.4 | — | 26.7 | 68.8 | 7.5 | 35.2 |
| 6 | 86.8 | 77.1 | 26.9 | 69.1 | 18.2 | 23 |
| 7 | 111.5 | — | 20.3 | 63.5 | 8.1 | 55.3 |

As can be seen in Table 5, the materials 1 to 4 and 7 (12% chromium steel) of this embodiment exhibited a 450° C., $10^5$ h creep rupture strength of not less than 51 kgf/mm², and a 20° C. V-notched Charpy impact strength of not less than 7 kgf-m/cm², so that it was confirmed that the materials had strength sufficient to be used as the materials for a high-temperature gas turbine.

Although the materials (low-alloy steel) to be used as the material for the stubshaft exhibited a low 450° C. creep rupture strength, they showed a tensile strength of not less than 86 kgf/mm² and a 20° C. V-notched Charpy impact strength of not less than 7 kgf-m/cm². It was therefore confirmed that they satisfied the value of the strength (represented by a tensile strength of 81 kg/mm² or above, and a 20° C. V-notched Charpy impact value of 5 kgf-m/cm² or above) required for the material for the stubshaft.

The gas turbine of this invention which was constituted by parts having a combination of the above-described materials was possible to obtain a compression ratio of 14.7, compressor air temperature of not less than 350° C., a compressor efficiency of not less than 86%, and a gas temperature of 1200° C. at the nozzle inlet of the first stage. Thus, it showed a thermal efficiency (LHV) of not less than 32%.

The temperature of the distant piece and that of the compressor disk located at the final stage in the gas turbine operated under the above-described conditions rose up to 450° C. at its maximum. It is preferable for the wall thicknesses of the former and the latter to be in the ranges between 25 and 30 mm and between 40 and 70 mm, respectively. The turbine disks and the compressor disks had a through-hole formed at the central portions thereof. Residual compressive stress was provided in the through-holes in the turbine disks.

Further, when the turbine spacer 4, the distant piece 5 and the compressor disk 6 of the final stage were formed of heat-resistant steels shown in Table 4 while the other parts were formed of the above-described steel, the resultant gas turbine was possible to obtain a compression ratio of 14.7, compressor air temperature of not less than 350° C., a compressor efficiency of not less than 86%, and a gas temperature of 1200° C. at the inlet of the nozzle of the first stage. It also exhibited a thermal efficiency (LHV) of not less than 32%, a high creep rupture strength, and a high impact strength value even after the material had been heated and became brittle. Thus, it was confirmed that the resultant gas turbine was highly reliable.

A gas turbine of this embodiment had 3-stage turbine disks 4. The turbine disks located upstream at the first and second stages have a central hole 11. The turbine disks are made of a heat-resistant steel having a composition shown in Table (4). Further, a compressor disk 6 located downstream at the final stage, a distant piece 19, turbine spacers 18, turbine stacking bolts 13, and compressor stacking bolts 8 were made of the heat-resistant material No. 7 shown in Table 4, and turbine blades 3, turbine nozzles 14, a liner 17 for a burner 15, compressor blades 7, compressor nozzles 16, diaphragms 2 and a shroud 1 were made of alloys having compositions shown in Table 6. In particular, the turbine nozzles 14 and the turbine blades 3 were constituted by castings.

The turbine blade, the turbine nozzle, and a shroud segment 1 and the diaphragm listed in Table 6 are those used at the first stages disposed at the upstream side thereof. A shroud segment 2 listed in Table 6 is the one used at the second stage.

TABLE 6

| | C (wt %) | Si (wt %) | Mn (wt %) | Cr (wt %) | Ni (wt %) | Co (wt %) | Fe (wt %) | Mo (wt %) | B (wt %) | W (wt %) | Ti (wt %) | Others (wt %) |
|---|---|---|---|---|---|---|---|---|---|---|---|---|
| Turbine Blade | 0.15 | 0.11 | 0.12 | 15.00 | Balance | 9.02 | — | 3.15 | 0.015 | 3.55 | 4.11 | Zr 0.05, Al 5.00 |
| Turbine Nozzle | 0.43 | 0.75 | 0.66 | 29.16 | 10.18 | Balance | — | — | 0.010 | 7.11 | 0.23 | Nb 0.21, Zr 0.15 |
| Liner for Burner | 0.07 | 0.83 | 0.75 | 22.13 | Balance | 1.57 | 18.47 | 9.12 | 0.008 | 0.78 | — | — |
| Compressor Blade, Nozzle | 0.11 | 0.41 | 0.16 | 12.07 | 0.31 | — | Balance | — | — | — | — | — |
| Shroud Segment | | | | | | | | | | | | |
| (1) | 0.08 | 0.87 | 0.75 | 22.16 | Balance | 1.89 | 18.93 | 9.61 | 0.005 | 0.85 | — | — |
| (2) | 0.41 | 0.65 | 1.00 | 23.55 | 25.63 | — | Balance | — | — | — | 0.25 | Nb 0.33 |
| Diaphragm | 0.025 | 0.81 | 1.79 | 19.85 | 11.00 | — | " | — | — | — | — | — |

Each of the turbine disks had a plurality of through-holes formed equiangularly on the whole periphery thereof through which holes bolts are inserted to couple the disks with each other.

The resultant gas turbine was possible to obtain a compression ratio of 14.7, compressor air temperature of not less than 350° C., a compression efficiency of not less than 86%, and a gas temperature of 1200° C. at the inlet of the first stage of the turbine nozzle. It also exhibits a thermal efficiency of not less than 32%. Further, as stated above, the turbine disks, the distant piece, the spacers, the compressor disk located at the final stage, and the stacking bolts were made of a heat-resistant steel having the above-described high creep rupture strength and in which steel the embrittlement apt to occur due to heating was minimized, the turbine blades were made of an alloy having an excellent high-temperature strength, the turbine nozzles were made of an alloy having excellent high-temperature strength and high-temperature ductility, and the liner for the burner was made of an alloy having an excellent high-temperature strength and a high thermal resistance. These made the resultant gas turbine a highly reliable one.

What is claimed is:

1. A gas turbine comprising moving turbine blades rotated by high-temperature gas, and a segment-shaped shroud provided in a spaced-apart relation to the tips of said moving blades, at least a sliding portion of said shroud, which sliding portion is in a sliding relation to said moving blades, being made of a heat-resistant cast alloy having a tensile strength of not less than 40 kgf/mm$^2$ and an elongation of not less than 5% both at a room temperature, a tensile strength of not less than 20 kgf/mm$^2$ and an elongation of not less than 5% both at 760° C., and a creep rupture time of not less than 10 hours under the conditions of 871° C. and 5.5 kgf/mm$^2$.

2. A gas turbine comprising a turbine stubshaft, a plurality of turbine disks coupled to said shaft by turbine stacking bolts, with spacer interposed therebetween, moving turbine blades planted in each of said disks, a shroud having a sliding surface in a spaced-apart relation to the tips of said moving blades, a distant piece connected to said disks by said bolts, a plurality of compressor disks coupled to said distant piece by compressor stacking bolts, compressor blades planted in each of said compressor disks, and a compressor stubshaft formed integrally with the first stage of said compressor disks, at least said turbine disks being made of martensitic steel having a wholly annealed martensitic structure and having a creep rupture strength of not less than 50 kgf/mm$^2$ under the conditions of 450° C. and $10^5$ and a V-notch Charpy impact strength of not less than 5 kgf-m/cm$^2$ after having been held at 500° C. for $10^3$ hours, said moving blade located at the downstream of combustion gas being made longer in length, said shroud being made of a heat-resistant case alloy having at least columnar grains directed inward from the sliding surface thereof, said heat-resistant cast alloy having a tensile strength of not less than 40 kgf/mm$^2$ and an elongation of not less 5% both at a room temperature, a tensile strength of not less than 20 kgf/mm$^2$ and an elongation of not less than 5% both at 760° C., and a creep rupture time of not less than 10 hours under the conditions of 871° C. and 5.5 kgf/mm$^2$.

3. A gas turbine according to claim 2, wherein said turbine stacking bolts, said distant piece, said turbine spacers, at least said compressor disks located from the final stage to the central stage, and at least one of said compressor stacking bolts are made of martensitic steel.

4. A gas turbine according to either of claims 2 and 3, wherein said martensitic steel comprises by weight of 0.05 to 0.2% C., not more than 0.5% Si, not more than 1.5% Mn, 8 to 13% Cr, 1.5 to 3.5% Mo, not more than 3% Ni, 0.05 to 0.3% V, 0.02 to 0.2% in total of at least one element selected from the group consisting of Nb and Ta, 0.02 to 0.1% of N, and the balance Fe and incidental impurities.

5. A gas turbine according to claim 4, wherein said martensitic steel has a creep rupture strength of not less than 50 kgf/mm$^2$ under conditions of 450° C. and $10^5$ hours, and a V-notch Charpy impact strength of not less than 5 kgf-m/cm$^2$.

6. A gas turbine according to claim 2, wherein said turbine shaft is formed of a material comprised by weight of 0.2 to 0.4% C, 0.5 to 1.5% Mn, 0.1 to 0.5% Si, 0.5 to 1.5% Cr, not more than 0.5% Ni, 1.0 to 2.0% Mo, 0.1 to 0.3% V, and the balance Fe and incidental impurities.

7. A gas turbine according to claim 2, wherein said turbine spacers are made of a material comprised by weight of 0.05 to 0.2% C, not more than 0.5% Si, not more than 1% Mn, 8 to 13% Cr, 1.5 to 3.0% Mo, not more than 3% Ni, 0.05 to 0.3% V, 0.02 to 0.2% Nb, 0.02 to 0.1% N, and the balance Fe and incidental impurities.

8. A gas turbine according to claim 2, wherein said turbine stacking bolts are made of a material comprised by weight of 0.05 to 0.2% C, not more than 0.5% Si, not more than 1% Mn, 8 to 13% Cr, 1.5 to 3.0% Mo, not more than 3% Ni, 0.05 to 0.3% V, 0.02 to 0.2% Nb, 0.02 to 0.1% N, and the balance Fe and incidental impurities.

9. A gas turbine according to claim 2, wherein said turbine distant piece is made of a material comprised by weight of 0.05 to 0.2% C, not more than 0.5% Si, not more than 1% Mn, 8 to 13% Cr, 1.5 to 3.0% Mo, not more than 3% Ni, 0.05 to 0.3% V, 0.02 to 0.2% Nb, 0.02 to 0.1% N, and the balance Fe and incidental impurities.

10. A gas turbine according to claim 2, wherein said compressor stacking bolts are made of a material comprised by weight of 0.05 to 0.2% of C, not more than 0.5% Si, not more than 1% Mn, 8 to 13% Cr, 1.5 to 3.0% Mo, not more than 3% Ni, 0.05 to 0.3% V, 0.02 to 0.2% Nb, 0.02 to 0.1% N, and the balance Fe and incidental impurities.

11. A gas turbine according to claim 2, wherein said compressor blades are made of a martensitic steel comprised by weight of 0.05 to 0.2% of C, not more than 0.5% Si, not more than 1% Mn, 10 to 13% Cr, and the balance Fe and incidental impurities.

12. A gas turbine according to claim 2, wherein said compressor disks disposed between the first stage and the central stage are made of a material comprised by weight of 0.15 to 0.30% C, not more than 0.5% Si, not more than 0.6% Mn, 1 to 2% Cr, 2.0 to 4.0% Ni, 0.5 to 1.0% Mo, 0.05 to 0.2% V, and the balance Fe and incidental impurities, other compressor disks disposed on the downstream side from said central stage with the exception of at least a compressor disk of the final stage being made of a material comprised by weight of 0.2 to 0.4% C, 0.1 to 0.5% Si, 0.5 to 1.5% Mn, 0.5 to 1.5% Cr, not more than 0.5% Ni, 1.0 to 2.0% Mo, and 0.1 to 0.3% V, and the balance Fe and incidental impurities.

13. A gas turbine according to claim 2, wherein said compressor stub shaft is made of a material consisting by weight of 0.15 to 0.3% C, not more than 0.6% Mn, not more than 0.5% Si, 2.0 to 4.0% Ni, 1 to 2% Cr, 0.5 to 1% Mo, and 0.05 to 0.2% V, and the balance Fe and incidental impurities.

14. A gas turbine comprising a turbine stubshaft, a plurality of turbine disks coupled to said shaft by means of turbine stacking bolts, with spacers interposed therebetween, moving turbine blades planted in each of said disks, a ring-shaped shroud having segments provided with a sliding surface in a spaced-apart relation to the tips of said moving turbine blades, turbine nozzles for guiding high-temperature gas to said blades to rotate the same, a plurality of cylindrical burners for generating said high-temperature gas, a distant piece coupled to said disks by said bolts, a plurality of compressor disks coupled to said distant piece by compressor stacking bolts, compressor blades planted in each of said disks, and a compressor stubshaft formed integrally with said compressor disk located at a first stage, a portion of said shroud which portion faces the turbine blade located at the first stage being made of Ni-base cast alloy having a wholly austenitic structure and comprised by weight of 0.05 to 0.2% C, not more than 2% Si, not more than 2$ Mn, 17 to 27% Cr, not more than 5% Co, 5 to 15% Mo, 10 to 30% Fe, not more than 5% W, not more than 0.02% B, and the balance Ni and incidental impurities, other portion of said shroud which face said turbine blades located at the remaining stages being made of Fe-base cast alloy comprised by weight of 0.3 to 0.6 C, not more than 2% Si, not more than 2% Mn, 20 to 27% Cr, 20 to 30% Ni, 0.1 to 0.5% Nb, 0.1 to 0.5% Ti, and the balance Fe and incidental impurities, and at least a portion of said shroud which portion is in sliding relation to the tips of said blades having columnar grains directed inward from said sliding surface; said portion being made of a heat resistant alloy having a tensile strength of not less than 40 kgf/mm$^2$ and an elongation of not less 5% both at a room temperature, a tensile strength of not less than 20 kgf/mm$^2$ and an elongation of not less than 5% both at 760° C., and a creep rupture time of not less than 10 hours under the conditions of 871° C. and 5.5 kgf/mm$^2$.

15. A gas turbine according to claim 14, wherein said compressor nozzles are made of a martensitic steel comprised by weight of 0.05 to 0.2% C, not more than 0.5% Si, not more than 1% Mn, 10 to 13% Cr, and the balance Fe and incidental impurities or another martensitic steel comprised of, in addition to the constituents of said former martensite steel, not more than 0.5% Ni, and not more than 0.5% Mo, said compressor disks located at a first stage and in a low-temperature side being made of a material comprised by weight of 0.15 to 0.3% C, not more than 0.5% Si, not more than 0.6% Mn, 1 to 2% Cr, 2 to 4% Ni, 0.5 to 1% Mo, 0.05 to 0.2% V, and the balance Fe and incidental impurities, other compressor disks located in a high-temperature side being made of a material comprised by weight of 0.2 to 0.4% C, 0.1 to 0.5% Si, 0.5 to 1.5% Mn, 0.5 to 1.5% Cr, not more than 0.5% Ni, 1 to 2% Mo, 0.1 to 0.3% V, and the balance Fe and incidental impurities.

16. A gas turbine according to claim 14, wherein said turbine blades are made of a Ni-base cast alloy having $\gamma'$ and $\gamma''$ phases and consisting by weight of 0.07 to 0.25% C, not more than 1% Si, not more than 1% Mn, 12 to 20% Cr, 5 to 15% Co, 1 to 5% Mo, 1 to 5% W, 0.005 to 0.03% B, 2 to 7% Ti, 3 to 7% Al, at least one element selected from the group consisting of not more than 1.5% Nb, 0.01 to 0.5% Zr, 0.01 to 0.5% Hf, and 0.01 to 0.5% V, and the balance Ni and incidental impurities, said turbine nozzles being made of a Co-base cast alloy having an austenitic matrix, eutectic carbide and secondary carbide and comprised by weight of 0.20 to 0.6% C, not more than 2% Si, not more than 2% Mn, 25 to 35% Cr, 5 to 15% Ni, 3 to 10% W, 0.003 to 0.03% B, and the balance Co and incidental impurities or another Co-base cast alloy comprised by weight of, in addition to the constituents of the former Co-base alloy, at least one element selected from the group consisting of 0.1 to 0.3% Ti, 0.1 to 0.5% Nb, and 0.1 to 0.3% Zr,, said burner being made of a Ni-base alloy having an austenitic structure and comprised by weight of 0.05 to 0.2% C, not more than 2% Si, not more than 2% Mn, 20 to 25% Cr, 0.5 to 5% Co, 5 to 15% Mo, 10 to 30% Fe, not more than 5% W, not more than 0.02% B, and the balance Ni and incidental impurities.

17. A segment-shaped shroud for a gas turbine which shroud is provided with a sliding surface in a spaced-apart relation to the tips of turbine blades rotated by high-temperature gas, at least a sliding portion of said shroud, the sliding surface of which portion is in sliding relation to said blade, being made of a heat-resistant cast alloy having in turn a chilled layer and columnar grains in a direction oriented from the sliding surface toward an inner part of the shroud; said heat-resistant cast alloy having a tensile strength of not less than 40 kgf/mm$^2$ and an elongation of not less 5% both at a room temperature, a tensile strength of not less than 20 kgf/mm$^2$ and an elongation of not less than 5% both at 760° C., and a creep rupture time of not less than 10 hours under the conditions of 871° C. and 5.5 kgf/mm$^2$.

18. A shroud for a gas turbine according to claim 17, wherein said heat-resistant cast alloy has a basic composition comprising by weight of 0.1 to 0.5% C, not more than 2% Si, not more than 2% Mn, 20 to 35% Cr, 18 to 40% Ni, and the balance Fe and incidental impurities or another composition comprised by weight of, in addition to said basic composition, at least one special element selected from the group consisting of not more than 0.5% Ti, not more than 0.5% Nb, not more than 0.5% at least one rare earth element, not more than 0.5% Y, not more than 0.5% Ca, not more than 0.5% Mg, and not more than 0.5% Al, or still another composition consisting by weight of, in addition to said basic composition or said another composition with said special element, at least one element selected from the group consisting of not more than 20% Co, not more than 10% Mo and not more than 10% W.

* * * * *